US006736091B1

(12) United States Patent
Tibbles

(10) Patent No.: US 6,736,091 B1
(45) Date of Patent: May 18, 2004

(54) VARIABLE COMPRESSION RATIO CONTROL SYSTEM FOR INTERNAL COMBUSTION ENGINE

(75) Inventor: Thomas Theodore Tibbles, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/248,289

(22) Filed: Jan. 6, 2003

(51) Int. Cl.[7] ..... F02B 75/04
(52) U.S. Cl. ..... 123/78
(58) Field of Search ..... 123/78 E

(56) References Cited

U.S. PATENT DOCUMENTS

| | | | | | |
|---|---|---|---|---|---|
| 3,667,433 | A | * | 6/1972 | Isley | 123/78 B |
| 4,031,868 | A | * | 6/1977 | Karaba et al. | 123/78 B |
| 4,457,211 | A | | 7/1984 | Risk | |
| 4,679,988 | A | | 7/1987 | Leorat et al. | |
| 4,864,977 | A | | 9/1989 | Hasegawa | |
| 5,136,987 | A | * | 8/1992 | Schechter et al. | 123/48 B |
| 5,146,879 | A | | 9/1992 | Kume et al. | |
| 5,178,103 | A | * | 1/1993 | Simko | 123/48 B |
| 5,247,911 | A | * | 9/1993 | Nenicka | 123/48 B |
| 5,762,134 | A | | 6/1998 | Droste et al. | |
| 6,394,047 | B1 | | 5/2002 | Rao et al. | |
| 6,397,796 | B1 | | 6/2002 | Styron et al. | |

FOREIGN PATENT DOCUMENTS

| | | | | |
|---|---|---|---|---|
| DE | 19844200 A1 | * | 6/1999 | F02B/75/32 |
| GB | 2059009 A | * | 9/1979 | F16J/1/00 |
| JP | 6-7621 | | 1/1994 | |

* cited by examiner

*Primary Examiner*—Willis R. Wolfe
*Assistant Examiner*—Douglas A Salser

(57) ABSTRACT

A variable compression ratio control system for an internal combustion engine includes a lubrication system for selectively providing lubricating oil to connecting rods within the engine at either a lubrication pressure or at a control pressure. The oil is provided to compression ratio adjusters so as to cause the adjusters to move from one compression ratio to another, to achieve a desired change in compression ratio. A lubricating pump provides lubricating oil to the connecting rods through the lubrication system. The lubricating pump is selectively operable at one of a lubricating pressure and a control pressure by means of a control valve which is integral with the lubricating pump.

17 Claims, 5 Drawing Sheets

| | Solenoids | | | | Gallery Press (psi) | | |
|---|---|---|---|---|---|---|---|
| State | Relief | Head | Hi CR | Lo CR | Head | Hi CR | Lo CR |
| Lube | Off | Off | Off | Off | 70 | 70 | 70 |
| High | On | On | Off | On | 0 | 140 | 0 |
| Low | On | On | On | Off | 0 | 0 | 140 |

Figure 2

VARIABLE COMPRESSION RATIO CONTROL SYSTEM FOR INTERNAL COMBUSTION ENGINE

BACKGROUND OF THE INVENTION

1. Field of the Invention

The present invention relates to an internal combustion engine having a system for controlling the engine's compression ratio by means of a dual purpose lubricating oil pump having variable pressure output.

2. Disclosure Information

For many years, engine designers have desired to implement variable compression ratio control systems for use with reciprocating internal combustion engines. The ability to control an engine's compression ratio is desirable because it is well known that higher compression ratios promote superior fuel economy, but at the expense of knocking operation in the event of either excessive engine loading or inferior quality fuel. With a variable compression ratio system, it is possible to run at an higher compression ratio during low engine load and to alter the compression ratio to operate at a lower compression ratio during operation at higher engine loads. Moreover, if variable compression ratio control capability is coupled with the ability to boost the engine such as through the use of a supercharger, very high specific output maybe achieved at high loads, while preserving the capability to obtain superior fuel economy with higher compression at lower loads.

Many types of variable compression ratio designs have been proffered. Some systems such as those proposed by the BICERI organization change the compression height of the piston through use of hydraulic elements. Other systems change compression height of the piston through the use of a elastic element such as a Belleville spring interposed between the crown of the piston and its main body.

U.S. Pat. No. 6,394,047B1, which is assigned to the assignee of the present invention, and which is hereby incorporated by reference in this specification, discloses and claims a variable compression ratio connecting rod which employs a grooved bearing to pick up an oil pressure switching signal from the crankshaft of the engine. The present invention deals with a system for providing that signal to the crankshaft.

Although there are known systems for providing a high pressure oil signal to a variable compression ratio system in an engine, such systems typically use an external pump or an added hydraulic pump having significantly greater complexity than pumps currently found on engines. These additional pump systems typically include numerous check valves, solenoid valves, hydraulic accumulators, additional pumping elements and other devices which greatly increase the cost of a variable compression ratio system. In contrast, the present system utilizes the engine driven lube oil pump as a dual purpose, multi-pressure device. In other words, only the single pump is needed. Moreover, the present system does not use any uniquely dedicated control passages. In another words, all of the oil passages are used for normal lubrication, with two of the passages having dual roles for use as both lubrication and control signal passages.

SUMMARY OF INVENTION

A variable compression ratio control system for an internal combustion engine includes a lubrication system for selectively providing oil to connecting rods within the engine at both a lubrication pressure and at a control pressure. A plurality of compression ratio adjusters is responsive to the pressure of lubricating oil being provided to the connecting roads through the lubrication system. One of the compression ratio adjusters is associated with each of the connecting rods. A lubricating pump provides lubricating oil to the connecting rods through the lubrication system. The lubricating pump is selectively operable at either the lubricating pressure or the control pressure.

The present system further includes a controller for sensing a plurality of engine operating parameters and for operating the lubricating pump at a pressure level which is dependent at least in part upon the sensed values of the engine operating parameters. The controller operates the lubricating pump and the valves of the variable compression ratio control system to cause the compression ratio adjusters to adjust to a lower compression ratio at higher engine loads and to a higher compression ratio at lower engine loads.

According to another aspect of the present invention, a lubricating pump comprises a supply element and a pressure relief element, with the pressure relief element being controllable so as to determine the pressure of lubricating oil discharged by the lubricating pump to the lubrication system. The supply element and pressure relief element are preferably located within a common housing, with the pump itself being driven by the engine.

According to another aspect of the present invention, the lubricating pump has an integral pressure regulator which comprises an elastic element for maintaining oil discharge pressure during normal operating condition and an electronically controlled valve for increasing discharge pressure when the compression ratio is being changed.

According to another aspect of the present invention, a compression ratio control system includes a lubrication system for providing lubricating oil to a plurality of components within an engine, with the lubrication system having a main bearing oil supply passage which is bifurcated into two passages such that the first group of main bearings is provided with oil by one of said passages, and a second group of main bearings is provided with oil by the other said passages. A plurality of compression ratio adjusters is responsive to the relative pressures of the lubricating oil being provided to the first and second groups of main bearings through the bifurcated oil passages. The compression ratio adjusters are switchable between a higher compression ratio and a lower compression ratio. The lubricating pump provides oil at a lower pressure during normal operation of the engine and at a higher pressure when the compression ratio adjusters are being switched from one compression ratio to the other compression ratio.

It is an advantage of the present invention that an engine may be equipped with a variable compression ratio controller without the necessity of adding another hydraulic pump with its attendant cost and complexity.

It is a further advantage of the present invention that implementation of a variable compression ratio control system according to this invention will necessitate only minor changes to many existing engine designs.

It is a further advantage of the present invention that the present system provides variable compression ratio with very little power consumption.

Other advantages, as well as objects and features of the present invention will become apparent to the reader of this specification.

BRIEF DESCRIPTION OF DRAWINGS

FIG. 2 is a table showing various control pressures and control valve settings for a control system according to the present invention.

DETAILED DESCRIPTION

Figure 1:
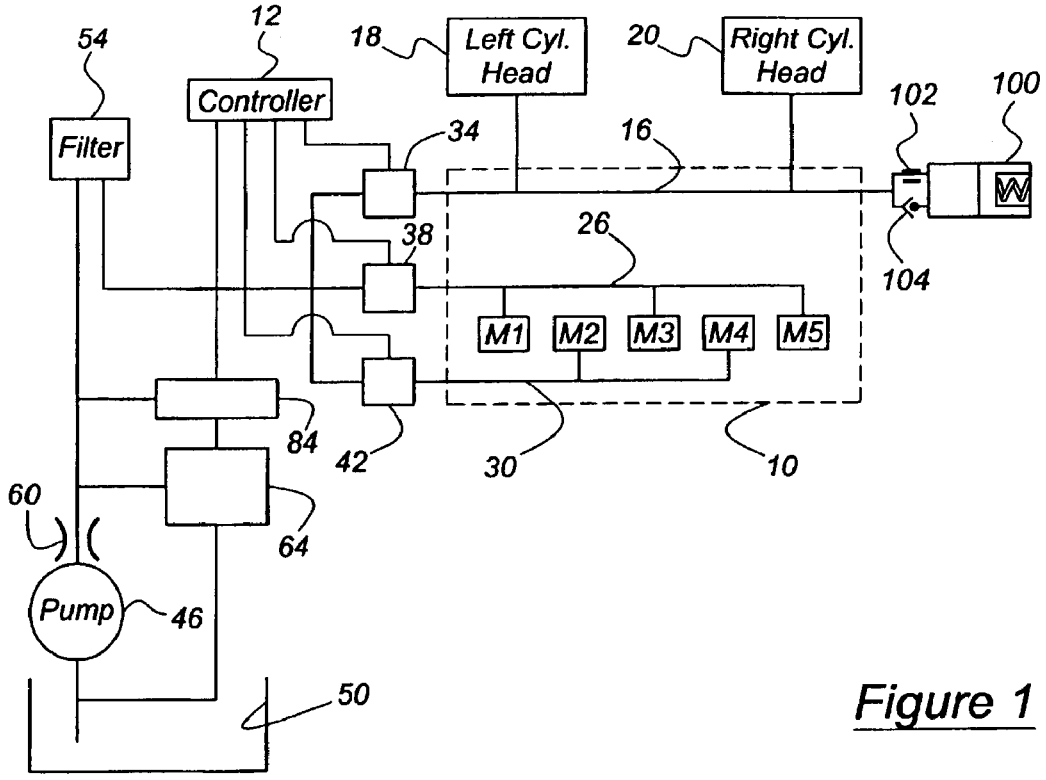
FIG. 1 is a schematic representation of an engine having a variable compression ratio control system according to the present invention.

As shown in FIG. 1, an engine having engine block 10 has three oil galleries. Head gallery 16 provides lubricating oil to left cylinder head 18 and right cylinder head 20. High compression ratio gallery 26 provides oil at both lubricating pressure and, as required, at a higher control pressure, to main bearings 1, 3 and 5 of the engine, which are labeled M1, M3, and M5. On the other hand, low compression ratio gallery 30 provides oil at normal lubricating pressure and, at a higher control pressure as needed, to main bearings 2 and 4 which are labeled M2 and M4. Thus, it is seen that the crankshaft of the engine illustrated in FIG. 1 has five main bearings. Those skilled in the art will recognize however, that a system according to this invention could be employed in an engine having a greater or lesser number of main bearings. What is important is that the crankpins of the crankshaft may be fed with oil at different pressures as required so that the compression ratio adjusters shown in FIG. 3 and described in the '047 patent, may be used.

Those skilled in the art will appreciate in view of this disclosure that controller 12, which controls the selective provision of high pressure oil to the present compression ratio adjusters, will sample a plurality of engine operating parameters such as engine speed, engine load, throttle position, transmission gear selection, spark timing, and other parameters. Although a number of algorithms known to those skilled in the art may be employed to indicate the need to switch the compression ratio, it is expected that engine load would enter into this decision, with lower engine loads indicating higher compression ratio and higher engine loads indicating lower compression ratio. Engine load may be inferred from such operating parameters as engine speed, throttle position, intake manifold pressure, fuel injection rate, spark timing, vehicle speed, transmission gear, and other operating parameters.

Figure 3:
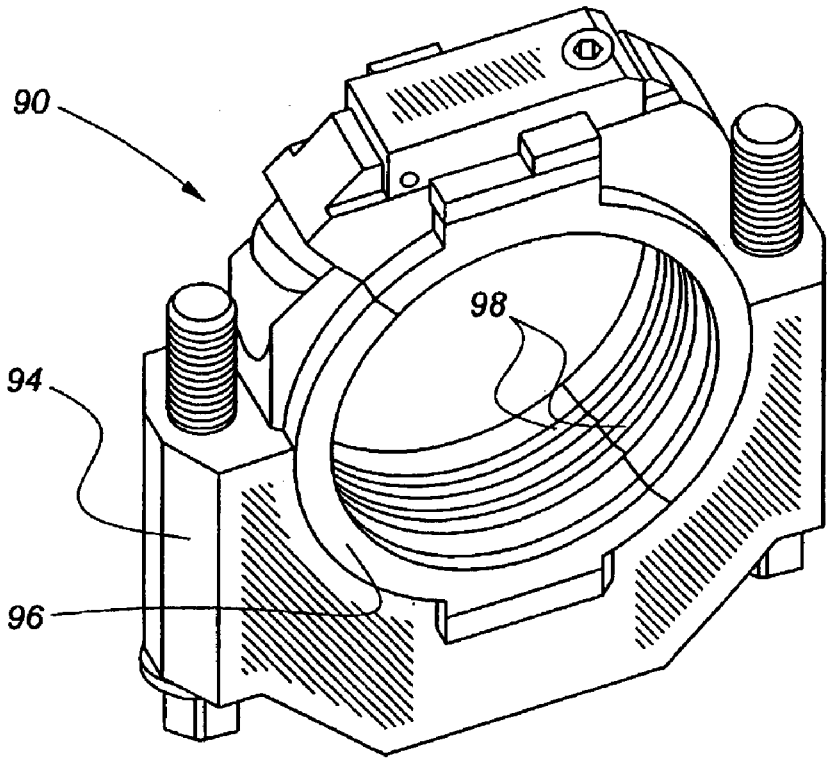
FIG. 3 illustrates a portion of an adjustable compression ratio connecting rod which is useful for practicing the present invention.

As shown in FIG. 3 connecting rod 90 having cap 94 has a plurality of grooves 98 formed in bearing 96. These grooves receive both lubricating oil and higher pressure control oil from an engine oil pump thereby, causing switching of the compression ratio of the engine by changing the effective length of the connecting rod, as set forth in the '047 patent. Those skilled in the art will appreciate in view of this disclosure that FIG. 3 does not include the smaller end of connecting rod 90 which would receive a wrist pin in conventional fashion.

The present invention deals with the manner in which lubricating oil may be supplied to the various main bearing galleries of the engine, at both a lower lubricating pressure, and, selectively, at a higher pressure sufficient to switch the compression ratio adjusters located within connecting rods 90. Oil provided to galleries 16, 26 and 30 arises from oil pump 46, which draws engine oil from pump 50. The oil passes first into filter 54 and then through three solenoid valves. Each of the valves 34, 38 and 42 is normally open. In other words, each of valves 34, 38, and 42 is open unless a voltage has been applied to the valve in its closed position. Valve 34 controls the flow from oil pump 46 to head gallery 16. Valve 38 controls the flow from pump 46 to high compression ratio gallery 26 and finally, normally open solenoid valve 42 controls the flow from pump 46 to low compression ratio gallery 30. During normal operation of the engine, pump 46 circulates oil at about 70 psi to the three galleries. This is shown in FIG. 2. As noted in FIG. 2, during the lubricating state, solenoid valves 34, 38 and 42 are in their normally open position. When each of solenoid valves 34, 38, 42 and 84 is in the open position, the pressure produced by pump 46 is determined solely by relief valve 64. In the case shown in line one of FIG. 2, cylinder head gallery 16 and high and low compression ratio galleries 26 and 30 are all at about 70 psi. Those skilled in the art will appreciate in view of this disclosure that the pressures shown in FIG. 2 are merely meant to be exemplary and may be shifted either up or down depending on the design requirements of any particular engine lubricating system and variable compression ratio control system provided by one wishing to practice the present invention.

In the event that it desirable to switch the compression ratio of an engine according to the present invention, head gallery solenoid valve 34 will be switched to the valve closed position. In another words, cylinder head solenoid valve 34 will be energized to the valve closed position. Moreover, one of the valves 38 and 42 will also be closed. If it is desired to obtain high compression ratio, valve 38 will be maintained in the open position. In other words valve 38 will kept open, whereas valve 42 will be energized to the closed position. Valve 84 will also be energized to the closed position. As a result, oil at approximately 140 psi, or at some other desired pressure selected by one employing present invention, will be directed to high compression ratio gallery 26, and the compression ratio adjusters of the FIG. 3 and '047 patent, for example, will be directed to switch to the high compression ratio setting. If on the other hand it is desired to move from the high compression ratio to the low compression ratio, solenoid valve 42 will be left in the "off" or "open" position whereas valves 34 and 38 will be closed, as will solenoid valve 84 attached to pump 46. In this manner, high pressure oil will be directed to low compression ratio gallery 30 and the adjusters associated with each connecting rod will be toggled to the low compression ratio setting.

Figure 4:
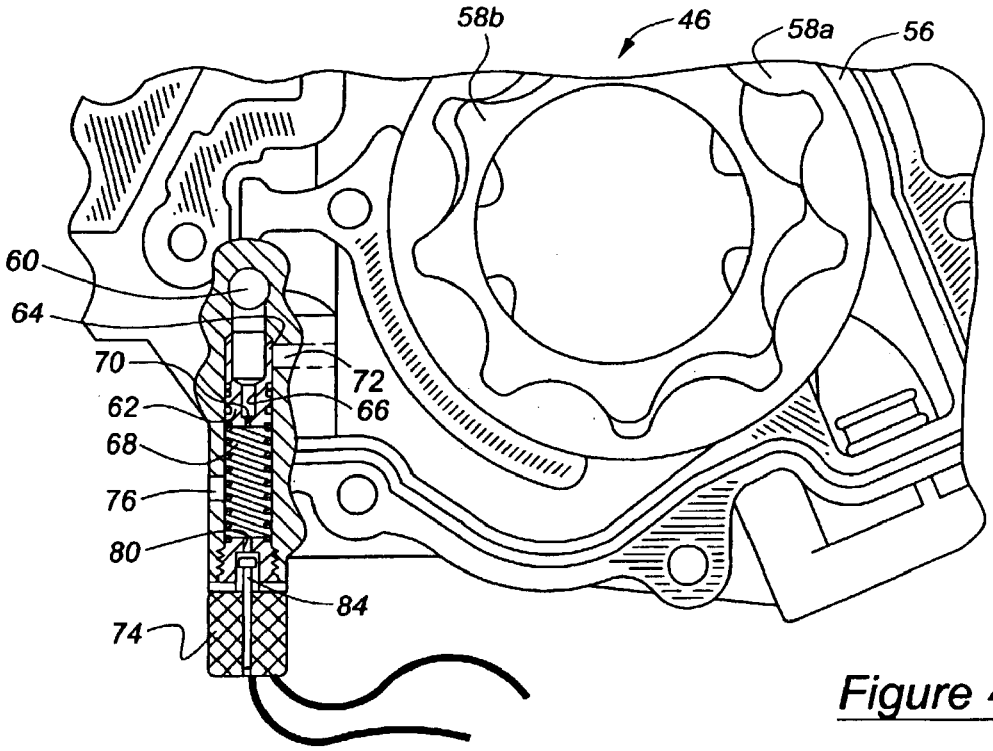
FIG. 4 illustrates a lubricating oil pump having a control valve system according to one aspect of the present invention.

Although other compression ratio control systems have used oil as a working fluid, the present system is advantageous because a single set of galleries is employed for furnishing both lubricant under normal pressure and higher control pressure to the main bearings and then to the crankshaft and to the connecting rods. FIG. 4 illustrates a gerotor pump having housing 56 and inner gerotor element **58*b* and an outer gerotor element 58*a*. Although a particular pump is shown as having a large inside diameter on gerotor element 58*b* sufficient to allow passage of the crankshaft of an engine, those skilled in the art will appreciate in view of this disclosure that other types gerotor pumps or gear pumps, or other types of positive displacement oil pumps could be utilized with a system according to the present invention. FIG. 4 also shows pump discharge port 60 as is also seen in FIG. 1. Pump relief valve 64** is one control element used in the delivery of both the high and low pressures needed for normal lubrication and also for higher pressure for switching the compression ratio controllers.

Pump relief valve 64 allows oil to be discharged to pump relief port 72, thereby limiting the pressure output of oil pump 46. Pump relief valve 64 is biased into a closed position by means of relief valve spring 68 but more importantly, by means of fluid pressure which also biases pump relief valve 64 into the closed position. This fluid pressure is controlled by valve orifice 70 which is drilled axially through pump relief valve 64. The normal relief pressure is further controlled by primary exhaust orifice 76 which is drilled through the side of valve bore 62. Finally, solenoid valve 84 further serves to control the pressure available at pump discharge port 60.

Solenoid valve 84, which has previously been described as being normally open, allows oil to flow through secondary exhaust orifice 80 when valve 84 is in its normally open position. Accordingly, the pressure at pump discharge port 60 depends upon the sizes of orifices 70, 76 and 80 during normal operation at lower lubricating pressure. This is the 70 psi setting noted in FIG. 2. If however, solenoid valve 84 is energized into its closed position by the application of current to coil 74, then the pressure available at pump discharge port 60 will be determined solely by the sizes of orifices 70 and 76. Because secondary exhaust orifice 80 will be closed by solenoid valve 84, pressure will be allowed to build up in valve bore 62 and the force resulting from this hydraulic pressure or fluid pressure acting on the backside of pump relief valve 64 will combine with the force produced by relief valve spring 68 to greatly increase the pressure available at pump discharge port 60. As further described above, this increased pressure will be selectively available at high compression ratio gallery 26, or low compression ratio gallery 30, so as to achieve the desired switching of compression ratio.

Figure 5:
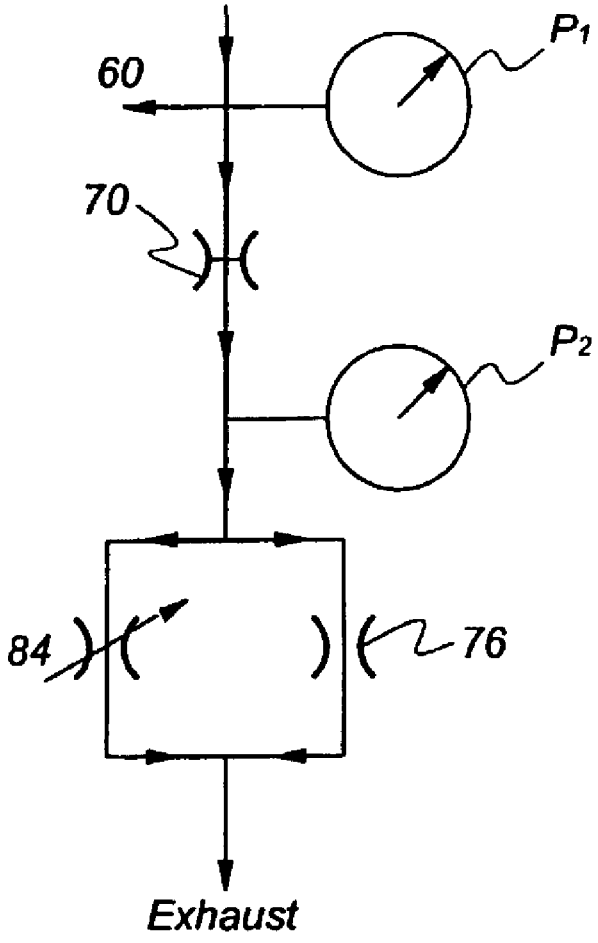
FIG. 5 is a hydraulic systematic illustrating operation of the pressure control valve incorporated in an engine oil pump according to the present invention.

FIG. 5 is a hydraulic schematic in which P1 represents the discharge pressure from pump 46. Valve orifice is shown as contributing to the determination of P1, as do valve 84 and primary exhaust orifice 76, which act together with relief valve spring 68 to produce P2, the unit pressure acting on the back side of relief valve 64.

According to another aspect of the present invention, a control system according to the present invention may further comprise, as shown in FIG. 1, hydraulic accumulator 100 which is hydraulically plumbed to head gallery 16 through orifice 102 and check valve 104. During normal operation of the engine, accumulator 100 will fill with oil. Then, when compression ratio is being switched and cylinder head solenoid valve 34 is turned off, oil will flow from accumulator 100 into cylinder head gallery 16. As a result, a variable valve timing control system (not shown) fed through cylinder head gallery 16 will be allowed to maintain proper operation for the brief interlude in which solenoid valve 34 is placed in the "off" or "closed" position.

Although the present invention has been described in connection with particular embodiments thereof, it is to be understood that various modifications, alterations, and adaptations may be made by those skilled in the art without departing from the spirit and scope of the invention. It is intended that the invention be limited only by the appended claims.

What is claimed is:

1. A variable compression ratio control system for an internal combustion engine, comprising:

a lubrication system for selectively providing oil to connecting rods within the engine at either a lubrication pressure or at a control pressure;

a plurality of compression ratio adjusters responsive to the pressure of lubricating oil being provided to the connecting rods through said lubrication system, with one of said compression ratio adjusters being associated with each of said connecting rods; and a lubricating pump for providing lubricating oil to said connecting rods through said lubrication system, with said lubricating pump being selectively operable at one of said lubricating pressure and said control pressure.

2. A variable compression ratio control system according to claim 1, further comprising a controller for sensing a plurality of engine operating parameters and for operating said lubricating pump at a pressure level which is dependent at least in part upon the sensed values of said engine operating parameters.

3. A variable compression ratio control system according to claim 2, wherein said controller operates said lubricating pump at a pressure level which causes said compression ratio adjusters to be adjusted to a higher compression ratio at lower engine loads.

4. A variable compression ratio control system according to claim 2, wherein said controller operates said lubricating pump at a pressure level which causes said compression ratio adjusters to be adjusted to a lower compression ratio at higher engine loads.

5. A variable compression ratio control system according to claim 1, wherein said lubricating pump comprises a supply element and a pressure relief element, with said pressure relief element being controllable so as to determine the pressure of lubricating oil discharged by the lubricating pump to said lubrication system.

6. A variable compression ratio control system according to claim 5, wherein said supply element and said pressure relief element are located within a common housing.

7. A variable compression ratio control system according to claim 1, wherein said lubricating pump is driven by said engine.

8. A variable compression ratio control system according to claim 1, wherein said lubricating pump comprises a gerotor pump driven by a crankshaft of said engine.

9. A variable compression ratio control system according to claim 1, further comprising a controller for sensing a plurality of engine operating parameters and for operating said lubricating pump at a pressure level which is dependent at least in part upon the sensed values of said engine operating parameters, wherein said controller selectively operates said lubricating pump at one of said lubricating pressure level corresponding to a higher compression ratio at lower load, and a higher control pressure level corresponding to a lower compression ratio at higher engine load.

10. A variable compression ratio control system according to claim 1, further comprising a controller for sensing a plurality of engine operating parameters and for operating said lubricating pump at a pressure level which is dependent at least in part upon the sensed values of said engine operating parameters, wherein said controller selectively operates said lubricating pump at the lubricating pressure level during normal engine operation, and a higher control pressure level when the compression ratio is being adjusted.

11. A variable compression ratio control system for an internal combustion engine having a crankshaft with a plurality of main bearings, and with a plurality of connecting rods being attached to said crankshaft, with said variable compression ratio control system comprising:

a lubrication system for providing lubricating oil to a plurality of components within the engine, with said lubrication system having a main bearing oil supply passage which is bifurcated into two passages such that a first group of main bearings is provided with oil by one of said passages, and a second group of main bearings is provided with oil by the other of said passages;

a plurality of compression ratio adjusters responsive to the relative pressures of the lubricating oil being provided to the first and second groups of main bearings through said bifurcated oil passages, with one of said compression ratio adjusters being associated with each of said connecting rods, and with said compression ratio adjusters being switchable between a higher compression ratio and a lower compression ratio; and a dual purpose lubricating pump for providing lubricating oil to said connecting rods through said bifurcated oil passages, with said lubricating pump having an integral pressure regulator which discharges oil from the pump at a lower pressure during normal operation of the engine, and at a higher pressure when the compression ratio adjusters are being switched from one compression ratio to the other compression ratio.

12. A variable compression ratio control system according to claim 11, further comprising a controller for operating the integral pressure regulator of said lubricating pump.

13. A variable compression ratio control system according to claim 11, wherein said pressure regulator comprises an elastic element for maintaining oil discharge pressure during normal operating conditions and an electronically controlled valve for increasing the discharge pressure when the compression ratio is being changed.

14. A variable compression ratio control system according to claim 13, wherein said electronically controlled valve is operated by a controller which senses a plurality of engine operating parameters and which controls the valve at a setting which is based at least in part upon the sensed values of said engine operating parameters.

15. A variable compression ratio control system according to claim 13, wherein said elastic element comprises a spring-biased relief valve, with said electronically controlled valve applying a fluid pressure bias to the relief valve, so as to increase the discharge pressure from the lubricating pump.

16. A variable compression ratio control system according to claim 13, further comprising a hydraulic accumulator for supplying lubricating oil to a variable valve timing actuator, with lubricating pump furnishing said accumulator with oil.

17. A method for operating a variable compression ratio control system for a reciprocating internal combustion engine, comprising the steps of:

determining a compression ratio at which the engine is to be operated;

increasing the discharge pressure of an engine lubricating pump from a lower pressure used during normal operation to a high pressure sufficient to operate a plurality of compression ratio adjusters; and applying lubricating oil at said higher pressure to said compression ratio adjusters to cause the compression ratio to be adjusted.

* * * * *